US006289821B1

(12) United States Patent
Amrath

(10) Patent No.: US 6,289,821 B1
(45) Date of Patent: Sep. 18, 2001

(54) RAIL VEHICLE, ESPECIALLY FOR LOCAL TRAFFIC

(75) Inventor: Johannes Amrath, Viersen (DE)

(73) Assignee: Siemens Duewag Schienenfahrzeuge GmbH, Krefeld (DE)

( * ) Notice: Subject to any disclaimer, the term of this patent is extended or adjusted under 35 U.S.C. 154(b) by 0 days.

(21) Appl. No.: 09/300,617

(22) Filed: Apr. 27, 1999

(30) Foreign Application Priority Data

May 22, 1998 (DE) ..... 198 23 010

(51) Int. Cl.[7] ..... B61F 3/00

(52) U.S. Cl. ..... 105/199.1; 105/158.2; 105/182.1; 105/200

(58) Field of Search ..... 105/182.1, 190.2, 105/191, 197.05, 199.1, 200, 207, 226, 159, 157.1, 203, 158.2; 267/3, 41

(56) References Cited

U.S. PATENT DOCUMENTS

| | | | | |
|---|---|---|---|---|
| 3,557,709 | * | 1/1971 | Hilfing et al. | 105/199.1 |
| 3,774,550 | * | 11/1973 | Lich | 105/182.1 |
| 3,802,350 | * | 4/1974 | Hicks et al. | 105/199.1 |
| 3,830,166 | * | 8/1974 | Dieling et al. | 105/182.1 |
| 3,913,495 | * | 10/1975 | Pelabon | 105/199.1 |
| 4,046,080 | * | 9/1977 | Dieling et al. | 105/182.1 |
| 4,362,109 | * | 12/1982 | Panagin | 105/182.1 |
| 4,660,476 | * | 4/1987 | Franz | 105/168 |
| 4,760,799 | * | 8/1988 | Jackson et al. | 105/182.1 |
| 4,773,334 | * | 9/1988 | Nowak et al. | 105/182.1 |
| 4,802,418 | * | 2/1989 | Okamoto et al. | 105/167 |
| 4,903,613 | * | 2/1990 | Lang et al. | 105/167 |
| 5,448,953 | * | 9/1995 | Bieker et al. | 105/158.2 |

FOREIGN PATENT DOCUMENTS

| | | |
|---|---|---|
| 68 00 267 | 1/1969 | (DE) . |
| 68 03 615 | 4/1969 | (DE) . |
| 80 059 | 11/1971 | (DE) . |

OTHER PUBLICATIONS

Simsen Kommt Mit Der Combino by Alfred Kortemeyer and Werner Osterhus, in Der Nahverkehr, Oct. 1995, pp. 79–82.

* cited by examiner

*Primary Examiner*—S. Joseph Morano
*Assistant Examiner*—Lars A. Olson
(74) *Attorney, Agent, or Firm*—Michael J. Striker

(57) ABSTRACT

The rail vehicle, especially for a streetcar or metropolitan transit car for local traffic, includes a car body (1) and an undercarriage (2) nonrotatably connected with each other by respective guide rods (3) each extending in a longitudinal direction. The connector members (3*a*) of these guide rods (3) facing the car body (1) and the corresponding receptacles (4) for them attached to the car body are arranged together in the central plane (M) of the undercarriage, which extends perpendicularly to the vehicle longitudinal axis (L). The connector members (3*a*) and the corresponding receptacles (4) are arranged together in the central plane (M) in a symmetrical arrangement so that a rapid reversal of the running direction of the undercarriage may be performed by only releasing the guide rods from their receptacles, rotating the undercarriage by about 180° and reconnecting the guide rods to the receptacles without moving the undercarriage from the first head end to the second head end of the car body (1). Alternatively the connector members (3*a*) of these guide rods (3) can be spaced a distance (a) from the central plane (M) of the undercarriage (2) and the receptacles (4) are equipped with connector pieces (4*a*) for spanning this distance (a), which are screwed on the receptacle (4), either in front of or behind the central plane (M) in a direction along the vehicle longitudinal axis (L).

8 Claims, 3 Drawing Sheets

RAIL VEHICLE, ESPECIALLY FOR LOCAL TRAFFIC

BACKGROUND OF THE INVENTION

The present invention relates to a rail vehicle, i.e. a vehicle that travels on the rails, and, more particularly, to a streetcar or a metropolitan transit car for local traffic, in which a car body and an undercarriage are connected with each other by means of at least one guide rod extending in a longitudinal direction.

The word "undercarriage" herein means driven and non-driven undercarriages with two or four wheels, which are connected pair-wise by means of a wheel shaft or which are free wheels, as well as drive bogies, trailing bodies and/or driven carriages.

Many different streetcars and metropolitan transit cars in six or eight axle embodiments are known in practice and from the professional literature. Usually a driven undercarriage is located under the head portion of the car body in this type of car, so that at least one non-driven undercarriage can be located in a middle region of the car. In order to prevent one-sided wheel wear, which is especially common with travel in one direction, the undercarriage is reversed or turned around after traveling, for example, 80,000 km or about once per year. Also the driven undercarriage can be released from its place at the head region of the car body and mounted under the other head region after being rotated about 180°. No greater difficulties are encountered in assembling the guide rods and other mechanically and electrically interfacial parts during the above-described reversal of the driving undercarriage because of the symmetry of the car body shape.

Subway vehicles formed from passenger-containing modules and undercarriage modules, which each have a car body and an undercarriage connected with each other by at least one guide rod extending in a longitudinal direction, are part of the state of the art as seen, for example, from the journal "Der Nahverkehr (Local Transit)", pp. 79 to 82, 10/95. FIG. 4 on page 81 of this journal shows a drive undercarriage with a guide rod of a guide rod pair, in which the opposite guide rod is covered by the undercarriage frame in the view. This FIG. 4 also shows a transverse shock absorber, which effects the transverse motion of the car body relative to the undercarriage, which is usually limited by an unshown mechanical stop device.

SUMMARY OF THE INVENTION

The invention is based on the understanding that it is desirable in regard to the reversal of the running direction of the undercarriage, to design the interfacial parts for the undercarriage, especially the guide rods, so that the respective undercarriages can be rapidly and easily rotated about 180° under the same car body (head region or assembly for the carriage module).

It is an object of the present invention to provide the necessary engineering features to fulfill this requirement.

This object and others which will be made more apparent hereinafter is attained in a rail vehicle, especially a streetcar or a metropolitan transit car for local traffic, in which a car body and an undercarriage are connected with each other by at least one guide rod extending in a longitudinal direction.

According to the invention a connector member of each guide rod facing the car body and a receptacle for it attached to the car body are arranged together in a central plane of the undercarriage extending perpendicularly to the vehicle longitudinal axis.

Because of the symmetry provided by the structure of the invention, in order to provide an advantageously rapid reversal or turning of the running direction of the undercarriage, it is only necessary to release the guide rod or rods from its receptacle or their receptacles and then to reconnect them. The receptacle guiding the motive power or force to the car body remain fixed on the car body. The vehicle can again receive passengers in a very short time again.

In an alternative form of the invention the connector member of each guide rod facing the car body has a longitudinal spacing from the central plane of the undercarriage that extents perpendicular to the vehicle longitudinal axis. The car body end of the receptacle or receptacles receiving the connector member or members is equipped with a connector piece that spans the longitudinal spacing and which is attached to the receptacle. The connector piece is displaced in front of or behind the central plane along the vehicle longitudinal axis.

Preferred embodiments of both forms of the invention are described hereinbelow and in the appended claims. A transverse shock absorber is provided in a symmetric manner in harmony with the objectives of the invention.

BRIEF DESCRIPTION OF THE DRAWINGS

The objects, features and advantages of the invention will now be illustrated in more detail with the aid of the following description of the preferred embodiments, with reference to the accompanying figures in which.

DESCRIPTION OF THE PREFERRED EMBODIMENTS

Figure 1:
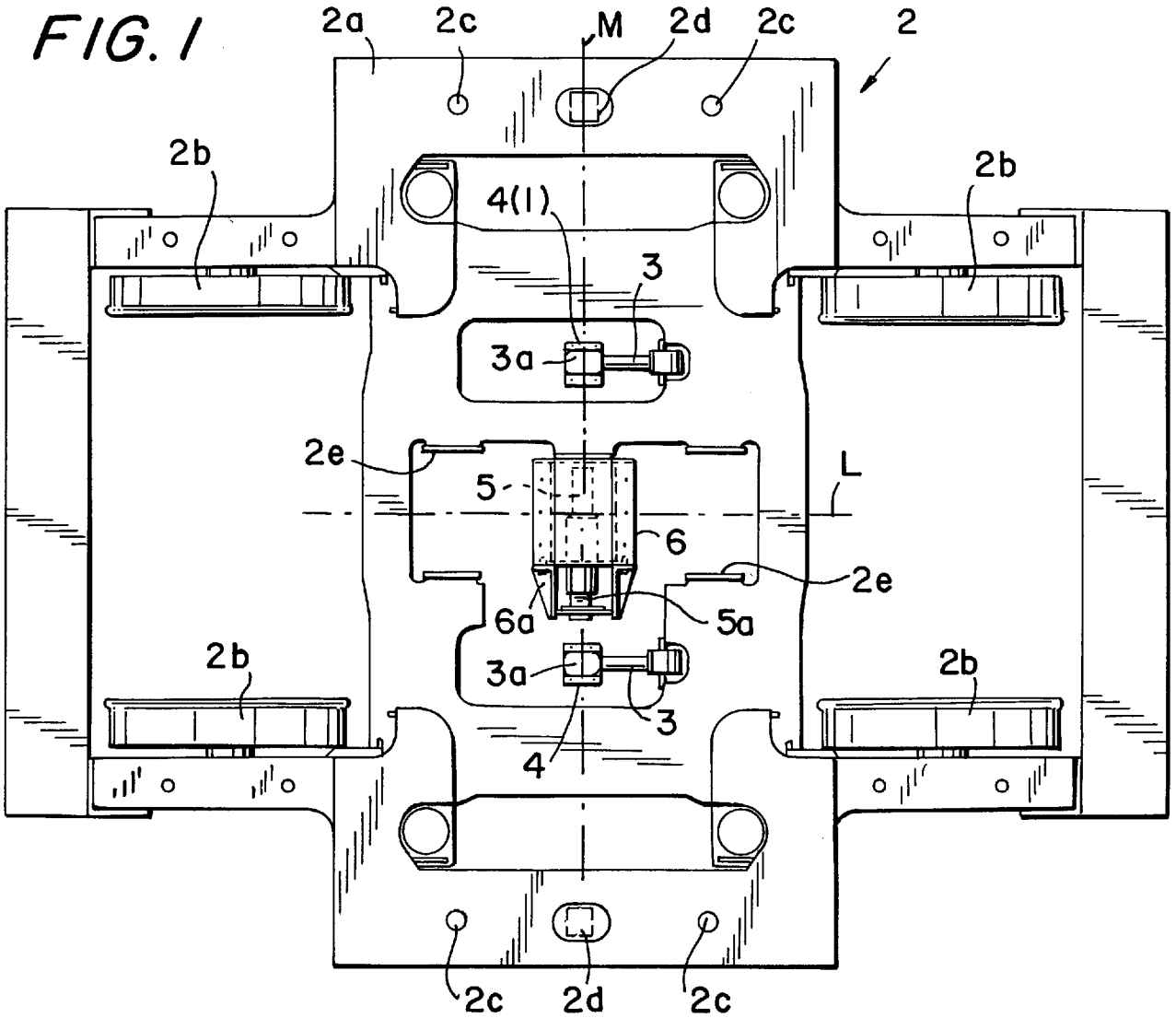
FIG. 1 is a top plan view of a first embodiment of an undercarriage of a rail vehicle according to the invention.
Figure 2:
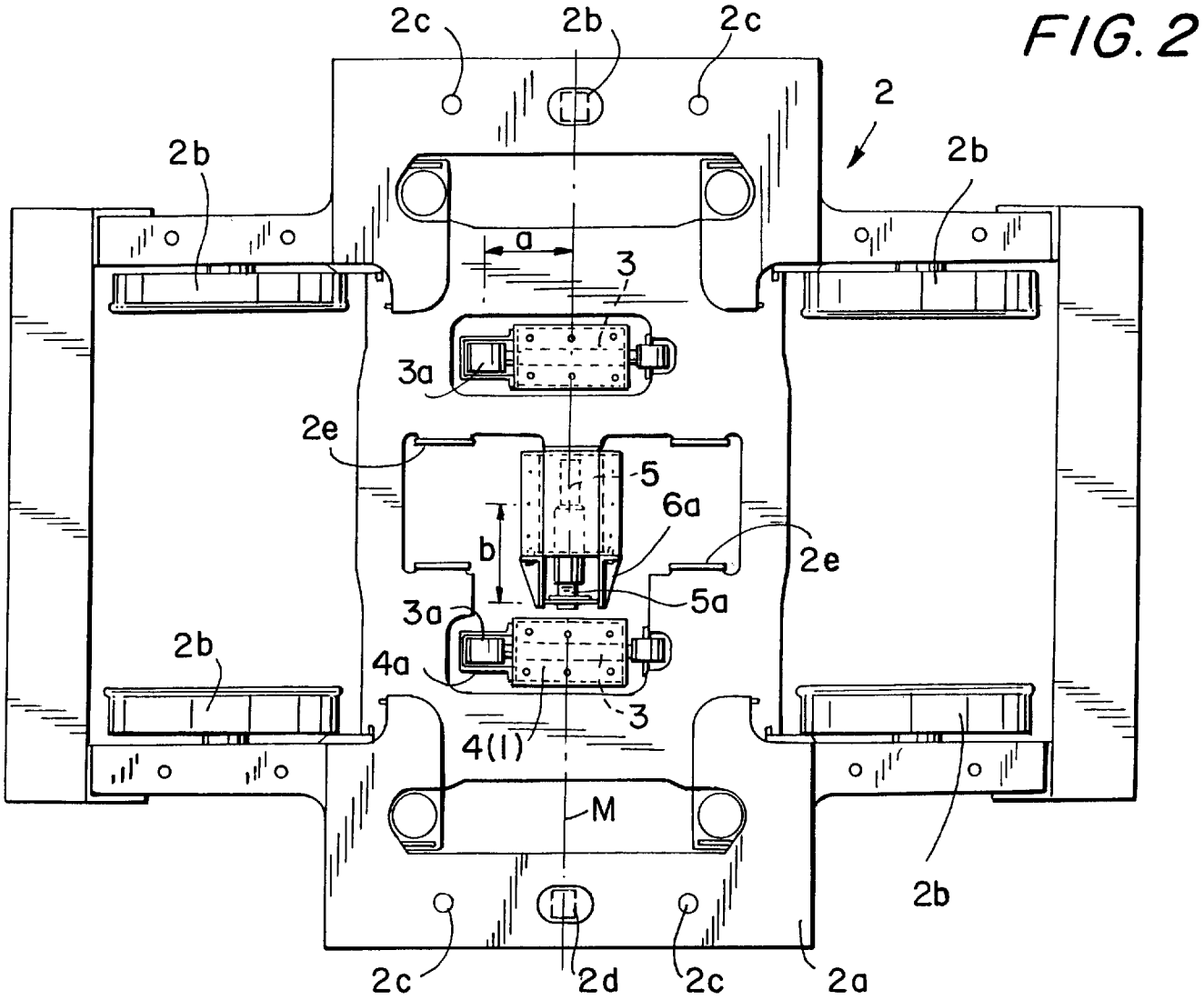
FIG. 2 is a top plan view of a second embodiment of an undercarriage of a rail vehicle according to the invention.

The respective undercarriage 2 shown in FIG. 1 and FIG. 2 comprise a frame 2*a* and four free wheels 2*b*. The frame 2*a* is equipped with attaching devices 2*c* for secondary springs and retaining elements 2*d* for a vertical shock absorber mechanism. The undercarriage 2 is connected with the car body 1 located above it by means of two guide rods 3 transmitting force in the longitudinal direction. Furthermore a transverse shock absorber 5 (see also FIG. 4) and stop elements 2*e* for limiting transverse motion, which cooperate with unshown resilient elements, are provided between the undercarriage 2 and the car body 1.

In the embodiment shown in FIG. 1 a connector member 3*a* of a guide rod 3 facing the car body 1 and a receptacle 4 for it attached to the car body 1 are arranged together in the central plane M of the undercarriage 2 extending perpendicularly to the vehicle longitudinal axis L. A connector member 5*a* of the transverse shock absorber 5 facing the car body 1 and the receptacle 6 for it attached to the car body 1 can be arranged in a sufficiently sized space with their respective longitudinal axes centered on the vehicle longitudinal axis L.

Figure 3:
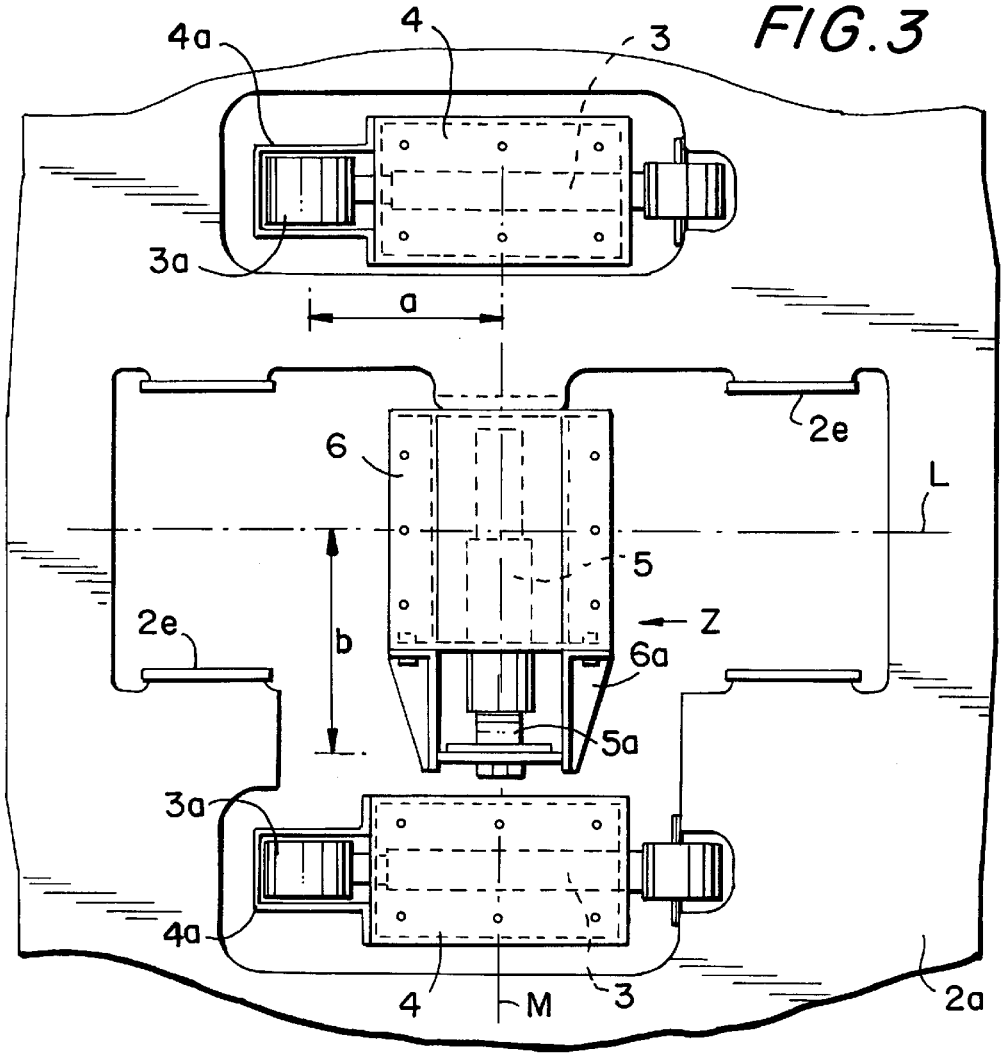
FIG. 3 is a detailed cutaway top plan view of a central portion of the undercarriage shown in FIG. 2.
Figure 4:
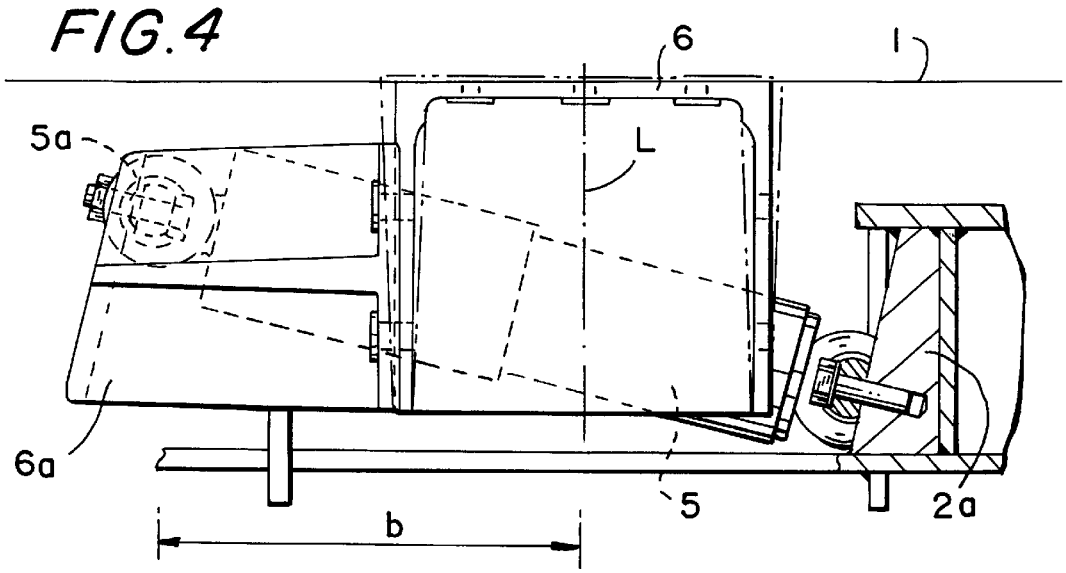
FIG. 4 is a detailed cutaway side view of the undercarriage shown in the direction of the arrow Z in FIG. 3.

In the embodiment shown in FIGS. 2 and 3 which differs from that in FIG. 1 the connector member 3*a* facing the car body 1 has a longitudinal distance or spacing a from the central plane M of the undercarriage 2. Here the car body end of the receptacle 4 is equipped with a connector piece 4*a* for spanning this longitudinal spacing a. The connector piece 4*a* is attached by screwing on the receptacle 4 and is displaced either in front of or behind the central plane M in the direction of the vehicle longitudinal axis L. A connector member 5*a* of the transverse shock absorber 5 facing the car body 1 has a transverse spacing b from the longitudinal axis of the undercarriage. A connector piece 6*a* is provided for the car body end of the receptacle 6 for the connector member 5*a*, which is open at both ends. The connector piece 6*a* is screwed on the receptacle 6 either left or right of the vehicle longitudinal axis L as shown in FIG. 4.

In an unshown embodiment of the invention the receptacles 4 for the guide rods 3 and the receptacles 6 for the transverse shock absorbers 5 are mounted on a common plate, which is attached by screws to the car body 1. The plate is provided with a symmetrical hole pattern so that it can be connected with the car body 1 in a first position or in another second position rotated 180° with respect to the first position according to the desired running direction of the undercarriage 2.

It is understood that all the standard interfacial connection elements and devices between the undercarriage and the car body, such as the stop device 2*e* for limiting the transverse motion, the attaching devices 2*c* of the secondary springs and the retaining devices 2*d* for the vertical shock absorber, and also the electrical connecting elements between the undercarriage and the car body are similarly designed so that the desired simple turning around or reversal of the running direction of the undercarriage is guaranteed.

The disclosure in German Patent Application 198 23 010.9 of May 22, 1998 is incorporated here by reference. This German Patent Application describes the invention described hereinabove and claimed in the claims appended hereinbelow and provides the basis for a claim of priority for the instant invention under 35 U.S.C. 119.

While the invention has been illustrated and described as embodied in a rail vehicle, especially for local transit or traffic, it is not intended to be limited to the details shown, since various modifications and changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and is set forth in the following appended claims:

1. A rail vehicle comprising a car body (1) having a first head region and a second head region;

an undercarriage (2) on which the car body (1) is mounted for rail travel;

two guide rods (3) for connecting the undercarriage (2) and the car body (1) with each other in said first head region so that the undercarriage is not pivotable relative to the car body, said two guide rods (3) extending in a direction of a vehicle longitudinal axis (L) and including respective connector members (3*a*), said respective connector members (3*a*) facing said car body (1); and two corresponding receptacles (4) receiving said respective connector members (3*a*) of said guide rods, wherein said receptacles (4) are attached to said car body (1);

wherein said guide rods (3) and said receptacles (4) are arranged together in a symmetrical arrangement in a central plane (M) of the undercarriage (2) and said central plane (M) extends perpendicularly to the vehicle longitudinal axis (L) so that a reversal of the running direction of the undercarriage (2) may be performed by only releasing the guide rods (3) from said receptacles (4), rotating the undercarriage by about 180° and reconnecting the guide rods (3) to the receptacles (4) without moving the undercarriage from the first head region to the second head region of the car body (1).

2. The rail vehicle as defined in claim 1, further comprising a transverse shock absorber (5) with a connector member (5*a*) facing the car body (1), a receptacle (6) for said connector member (5*a*) attached to said car body (1) and stop elements (2*e*) limiting transverse motions of the car body (1) relative to the undercarriage (2), and wherein said shock absorber (5) and said stop elements (2*e*) are arranged between said car body (1) and said undercarriage (2) and wherein said shock absorber (5) and said receptacle (6) extend centered across said vehicle longitudinal axis (L).

3. The rail vehicle as defined in claim 1, further comprising a transverse shock absorber (5) with a connector member (5*a*) facing the car body (1), a receptacle (6) for said connector member (5*a*) attached to said car body (1), said receptacle (6) having a connector piece (6*a*), and stop elements (2*e*) limiting transverse motions of the car body (1) relative to the undercarriage (2), and wherein said shock absorber (5) and said receptacle (6) are arranged between said car body (1) and said undercarriage (2), said connector member (5*a*) has a transverse spacing (b) from the vehicle longitudinal axis (L) and said connector piece (6*a*) spans said transverse spacing (b) and is screwed on said receptacle (6) to the left or right side of said vehicle longitudinal axis (L).

4. The rail vehicle as defined in claim 1 and consisting of a streetcar or a metropolitan transit car for local or commuter traffic.

5. A rail vehicle comprising a car body (1) having a first head region and a second head region;

an undercarriage (2) on which the car body (1) is mounted for rail travel;

two guide rods (3) for connecting the undercarriage (2) and the car body (1) with each other in said first head region so that the undercarriage is not pivotable relative to the car body, said two guide rods (3) extending in a direction of a vehicle longitudinal axis (L) and including respective connector members (3*a*), said respective connector members (3*a*) facing said car body (1); and two corresponding receptacles (4) receiving said respective connector members (3*a*) of said guide rods, wherein said receptacles (4) are attached to said car body (1) and said receptacles (4) are equipped with respective connector pieces (4*a*);

wherein each of said connector members (3*a*) of said guide rods (3) has a longitudinal spacing (a) from a central plane (M) of said undercarriage (2), said central plane (M) extends perpendicularly to the vehicle longitudinal axis (L) and said respective connector pieces (4*a*) of said receptacles (4) span said longitudinal spacing (a) and are screwed in said receptacle either in front or behind said central plane (M) in a direction of said vehicle longitudinal axis (L) and said guide rods (3) and said receptacles (4) are arranged in a symmetrical arrangement so that a reversal of the running direction of said undercarriage (2) may be performed by only releasing the guide rods (3) from said receptacles (4), rotating the undercarriage by about 180° and reconnecting the guide rods (3) to the receptacles (4) without moving the undercarriage from the first head region to the second head region of the car body (1).

6. The rail vehicle as defined in claim 5, further comprising a transverse shock absorber (5) with a connector member (5*a*) facing the car body (1), a receptacle (6) for said connector member (5*a*) attached to said car body (1) and stop elements (2*e*) limiting transverse motions of the car body (1) relative to the undercarriage (2), and wherein said shock absorber (5) and said stop elements (2*e*) are arranged between said car body (1) and said undercarriage (2) and wherein said shock absorber (5) and said receptacle (6) extend centered across said vehicle longitudinal axis (L).

7. The rail vehicle as defined in claim 5, further comprising a transverse shock absorber (5) with a connector member (5*a*) facing the car body (1), a receptacle (6) for said connector member (5*a*) attached to said car body (1), said receptacle (6) having a connector piece (6*a*), and stop elements (2*e*) limiting transverse motions of the car body (1) relative to the undercarriage (2), and wherein said shock absorber (5) and said receptacle (6) are arranged between said car body (1) and said undercarriage (2), said connector member (5*a*) has a transverse spacing (b) from the vehicle longitudinal axis (L) and said connector piece (6*a*) spans said transverse spacing (b) and is screwed on said receptacle (6) to the left or right side of said vehicle longitudinal axis (L).

8. The rail vehicle as defined in claim 5 and consisting of a streetcar or a metropolitan transit car for local or commuter traffic.

* * * * *